United States Patent [19]

Howard et al.

[11] 3,934,469

[45] Jan. 27, 1976

[54] METHOD AND STEAM SAMPLERS

[75] Inventors: Curtis E. Howard, Humble; Douglas G. Calvin, Houston, both of Tex.

[73] Assignee: Texaco Inc., New York, N.Y.

[22] Filed: Nov. 29, 1974

[21] Appl. No.: 528,073

[52] U.S. Cl. ..... 73/155; 166/264

[51] Int. Cl.[2] ..... E21B 47/00

[58] Field of Search ..... 73/155, 421.5, 425.4; 166/57, 264

[56] References Cited

UNITED STATES PATENTS

| | | | |
|---|---|---|---|
| 3,103,813 | 9/1963 | Bourne, Jr. et al. | 73/155 |
| 3,249,054 | 5/1966 | Hill | 73/155 |

*Primary Examiner*—S. Clement Swisher

*Attorney, Agent, or Firm*—T. H. Whaley; C. G. Ries; Theron H. Nichols

[57] ABSTRACT

Two methods and two steam samplers are disclosed for sampling steam, as at the bottom of a steam injection well for determining the quality of the saturated steam just prior to penetrating the formation. The samplers each comprises an elongated cylindrical vessel with a tube having openings extending longitudinally internally of the vessel for forming an annulus between the vessel and the tube for trapping steam liquid phase while ejecting the steam vapor phase. The tube has a second internally sliding tube for closing the openings and a latch for releasably locking the tubes in closed position for sealing the steam liquid phase in the annulus for recovery at the surface. A method for sampling and a method for forming a sampler, as well as two latch combinations are disclosed.

19 Claims, 6 Drawing Figures

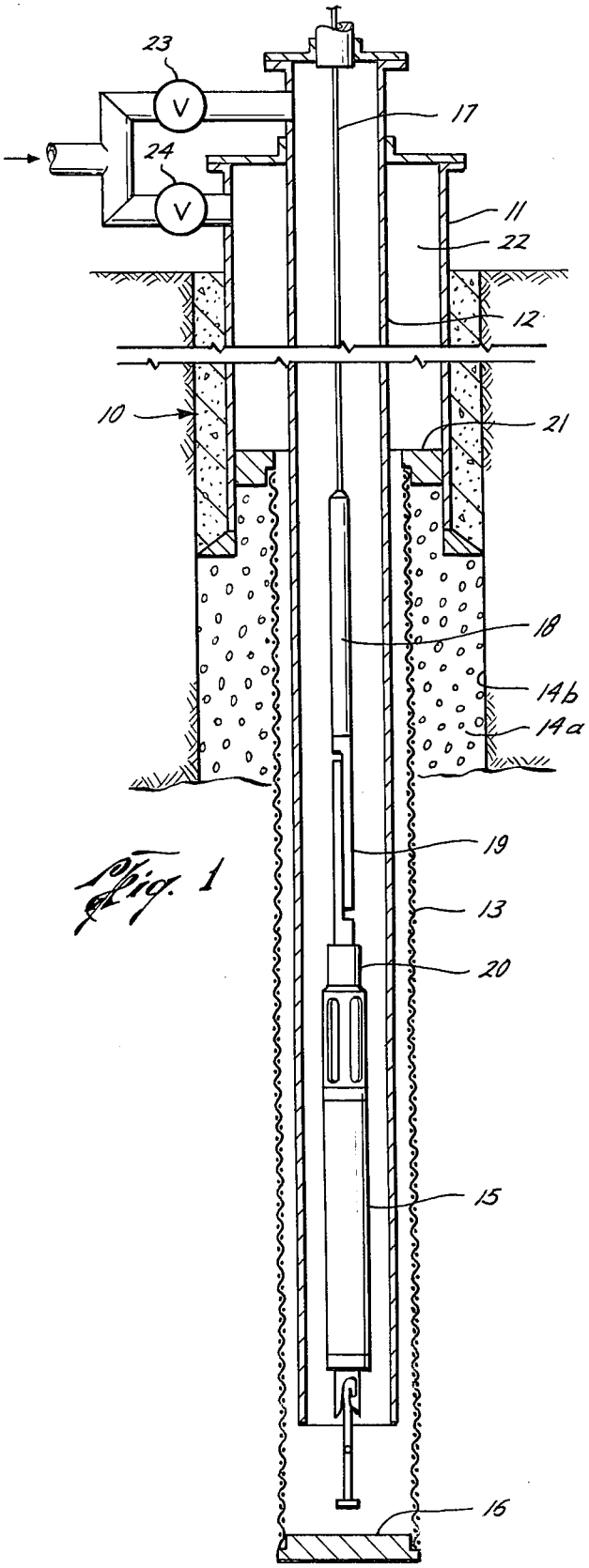
Fig. 1
Fig. 2
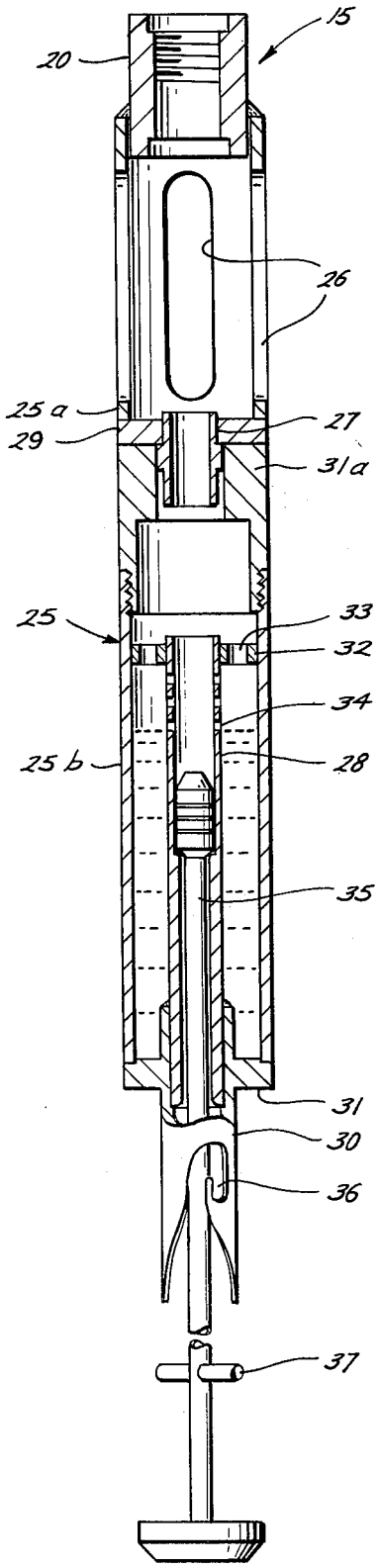

METHOD AND STEAM SAMPLERS

BACKGROUND OF THE INVENTION

As an aid to improving steam flood efficiency in secondary recovery in old oil or depleted wells for example, it is greatly beneficial to know the steam quality at the bottom of the well or sandface of a steam injection well. It would be desirable to collect and trap a representative sample of the steam liquid droplets flowing to the sandface and retrieve this sample for analyzing. The sample could then be checked for either total dissolved solids or chloride content and compared to the steam generator feedwater total dissolved solids or chlorides. Hence, the quality may be determined from a ratio of the total dissolved solids or chlorides of the steam entering the wellhead to the total dissolved solids or chlorides in the steam liquid droplets from the sampler at any desired location in the well, as at the bottom of the well.

OBJECTS OF THE INVENTION

Accordingly, a primary object of this invention is to provide at least one method for collecting a sample of steam at the bottom of a well to determine the quality of the steam that has arrived at the bottom for injection purposes, for example, compared to the quality at the steam prior to entry into the well.

Another primary object of this invention is to provide at least one method for forming a sampler for sampling steam at the bottom of a well.

And still another primary object of this invention is to provide at least two samplers for sampling steam at the bottom of a well.

A further object of this invention is to provide a method for sampling steam at the bottom of a well, a method for forming a sampler for sampling steam at the bottom of a well, and at least two steam samplers, each of which is easy to operate, is of simple configuration, is economical to build and assemble, and is of greater efficiency for sampling steam at the bottom of a well just prior to penetrating the surface of a petroliferous strata of an oil well, for example.

Other objects and various advantages of the disclosed methods and steam samplers will be apparent from the following detailed description, together with the accompanying drawings, submitted for purposes of illustration only and not intended to define the scope of the invention, reference being had for that purpose to the subjoined claims.

BRIEF DESCRIPTION OF THE DRAWINGS

The drawings diagrammatically illustrate by way of example, not by way of limitation, two forms or mechanisms for carrying out the methods of the invention wherein like reference numerals have been employed to indicate similar parts in the several views in which:

FIG. 1 is a schematic longitudinal sectional view of the sampler while hanging from a wireline near the bottom of the well;

FIG. 2 is a schematic longitudinal sectional view of one embodiment of the sampler, per se;

DESCRIPTION OF THE INVENTION

Figure 3A:
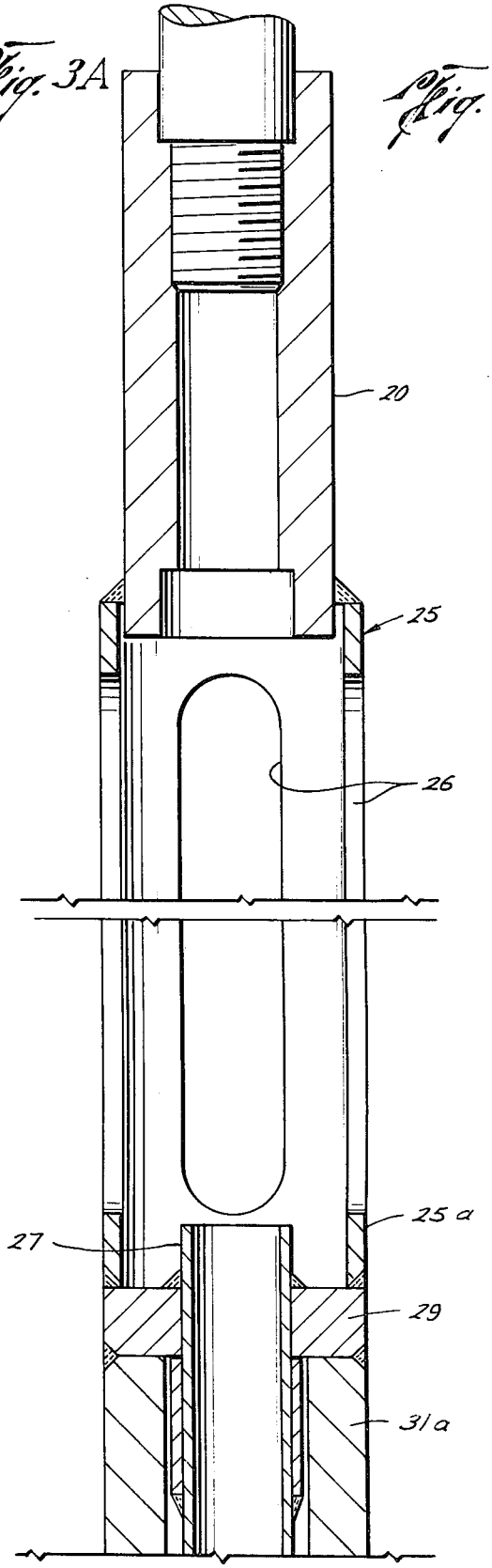
FIG. 3A is an enlarged sectional view of the upper portion of the sampler of FIG. 2.

The invention disclosed herein, the scope of which being defined in the appended claims, is not limited in its application to the details of construction and arrangement of parts shown and described for carrying out the disclosed methods, since the invention is capable of other embodiments for carrying out other methods and of being practiced or carried out in various other ways. Also, it is to be understood that the phraseology or terminology employed herein is for the purpose of description and not of limitation. Further, many modifications and variations of the invention as hereinbefore set forth will occur to those skilled in the art. Therefore, all such modifications and variations which are within the spirit and scope of the invention herein are included and only such limitations should be imposed as are indicated in the appended claims.

DESCRIPTION OF THE METHODS

This invention comprises a method for sampling steam at any location from the bottom to the top of a well for determining the quality of the steam just prior to injecting into the formation, a method for forming a steam sampler, and two mechanisms for practicing the methods.

METHOD FOR SAMPLING STEAM

A typical method of the invention for collecting a sample of steam at the bottom of a well to determine the quality of the steam that has arrived at the bottom for injection into the petroliferous strata formation relative to the steam quality input at the surface comprises the method steps of, 1. passing the steam that has arrived at the desired location in the well, such as but not limited to the well bottom through slots into the upper end of a cylindrical vessel,
2. passing the steam from the slotted upper end of the cylindrical vessel down into the upper end of a tube means positioned longitudinally internally of the cylindrical vessel,
3. passing a portion of the steam comprising vapor phase and liquid phase straight through the tube means to exit from the bottom of the cylindrical vessel,
4. passing the remainder of the steam vapor phase and liquid phase through an opening in the tube means out into an annulus formed between the tube and the cylinder,
5. passing the steam vapor phase portion that has entered the annulus back out of the annulus through holes in the tube means,
6. passing the steam vapor phase from the holes in the tube means out of the lower end of the cylindrical vessel,
7. collecting the steam liquid phase in the annulus until the liquid level reaches the lowest opening in the tube means for collecting a predetermined amount of liquid phase as about 200cc in the disclosed embodiments of the annulus,
8. flowing out of the annulus an amount of liquid phase equal to the new steam liquid phase collected thereafter to purge the annulus of the first formed steam liquid phase, and
9. sealing the sample of steam liquid phase in the annulus for recovery at the surface.

More briefly stated the method for collecting a sample of well bottom steam comprises, 1. passing the steam that has arrived at the well bottom through a tube means internally of a cylindrical vessel, 2. passing a portion of the steam vapor phase and liquid phase through an opening in the tube means out into an annulus formed between the tube means and the cylindrical vessel, 3. passing the steam vapor phase back into the tube means through openings therein and out the lower end of the tube means, 4. collecting the steam liquid phase in the annulus, and 5. sealing the annulus with a sample of steam liquid phase therein for recovery at the surface.

METHOD FOR FORMING A STEAM SAMPLER

A method for forming a sampler for collecting a sample of steam at the bottom of a well to determine the quality of the steam that has arrived at the bottom for injection into the petroliferous strata formation relative to the steam quality input at the surface comprises the method steps of, 1. forming an elongated cylinder having closed upper and lower ends with a diameter substantially less than that of the well to be sampled, 2. attaching a coupling means on the cylinder upper end for connecting support means thereto for lowering the cylinder to any desired position in the well, such as but not limited to adjacent the well bottom, 3. forming slots in the cylinder upper end for receiving steam, 4. fixedly mounting with an annular disk the top of an upper tube of two upper and lower co-axial, spaced apart tubes concentrically in the upper portion of the cylinder below the slots for receiving the steam from the slots and for sealing the top of the upper portion of an annulus formed between the tubes and the cylinder, 5. fixedly mounting with a second annular disk the lower end of the lower co-axial tube concentrically in the cylinder lower end for sealing the bottom of the lower portion of the annulus formed between the tubes and the cylinder, 6. spacing the two co-axial tubes axially from each other a substantial distance so that a portion of the steam including the steam liquid phase and the steam vapor phase passes out into the annulus, 7. perforating the upper end of the lower tube so that the steam vapor phase passes back into the lower tube through the perforations therein for exhausting from the cylinder bottom as the steam liquid phase collects in the annulus up to the perforations, 8. slideably mounting a sealing tube internally of the lower co-axial tube with a lower portion of the sealing tube protruding below the cylinder so that upon contact of the sealing tube lower portion with the well bottom the sealing tube is slid upwardly to its uppermost position to close the perforations and the spacing between the two tubes for sealing the annulus with steam liquid therein for recovery at the surface, and 9. said slideably mounted sealing tube has latch means for releasably locking the sealing tube in its uppermost position for sealing the steam liquid phase in the annulus for recovery at the surface.

One variation of the method above in the forming of a sampler comprises incorporation of the following method step, 1. mounting a corresponding latch on the cylinder lower end for connecting with the latch means on the sealing tube for locking the sealing tube in its uppermost position for sealing the liquid phase in the annulus.

Another variation of the method of forming a sampler above comprises the incorporation of the following method step, 1. mounting a corresponding latch on the upper coaxial tube for connecting with the latch means on the sealing tube for locking the sealing tube in its uppermost position for sealing the liquid phase in the annulus.

A STEAM SAMPLER

FIG. 1 illustrates schematically an injection well, 10 for example, having casing 11 in which steam is generated on the surface and injected under high pressure through valves 23 and 24 into the well, as down inside of tube 12, for example, to emerge at the bottom for penetrating a screen 13, gravel pack 14*a*, and for passing into the petroliferous formation 14*b* for displacing the oil therein toward product wells near by.

Further in FIG. 1 is the disclosed steam sampler 15 supported just above plate 16 on the bottom of screen 13 by a typical wireline 17 having a weight 18, a set of mechanical jars 19, and a suitable sucker rod coupling 20. The bottom of the screen represents the location of the lower portion of the petroliferous formation strata, whether it be at the actual bottom of the well, as illustrated, or anywhere along the well. In this disclosure, the term "bottom of the well" refers to the bottom of the petroliferous strata, as illustrated. Also, plate 16, FIG. 1, may comprise instead a collar stop including cross-pins thereon for contacting the bottom of the sealing tube 35, FIG. 2, as it is lowered in the well, which contact actuates pin 37 up into latching position with the J-latch 36. Since the cross-pins offer little resistance to steam or oil flow through the well, they can be set at any location in the well between the top and the bottom, wherever the steam quality is desired.

While steam is supplied from a suitable source to steam valves 23 and 24 internally of either the tube 12, or the annulus 22 formed between the tube and the casing 11 as controlled with valves 23 and 24, the steam must be supplied through tube 12 when the sampler is lowered in the tube for taking a sample.

Figure 3B:
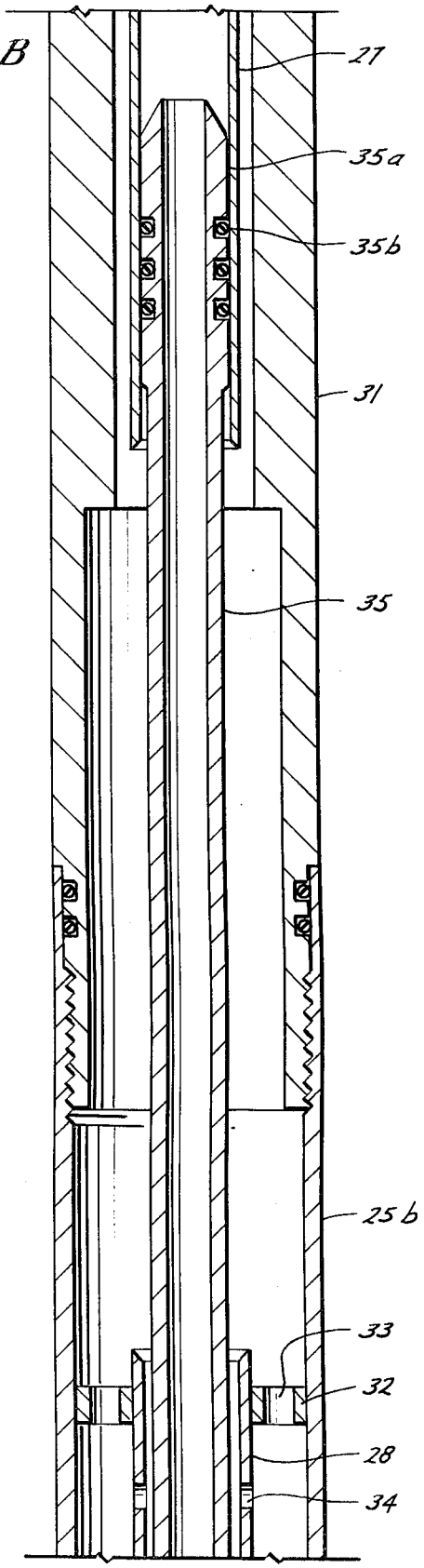
FIG. 3B is an enlarged sectional view of the middle portion of the sampler of FIG. 2.
Figure 3C:
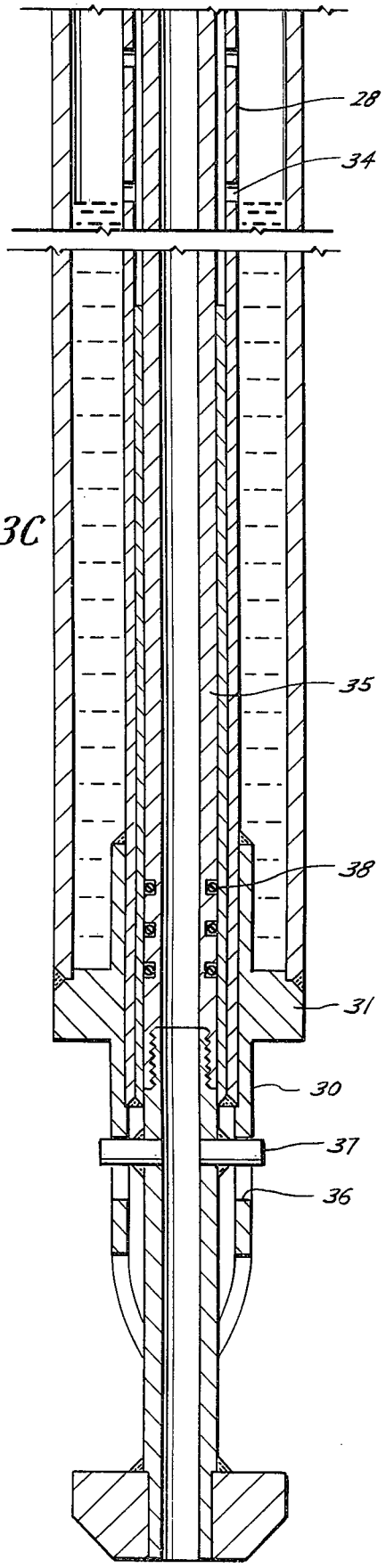
FIG. 3C is an enlarged sectional view of the lower portion of the sampler of FIG. 2.

FIG. 2, an enlarged longitudinal sectional view of one embodiment of the sampler 15, per se, and FIGS. 3A–3C are detailed views of the sampler. An elongated cylindrical vessel 25 FIGS. 2 and 3A is disclosed with slots 26 in the walls of the upper end and with two coaxial, upper and lower tubes 27, 28, FIG. 2, mounted concentrically in the cylindrical vessel extending from a position just under the slots to the bottom of the vessel to protrude therefrom.

The upper end of the cylindrical vessel 25, FIGS. 2 and 3A, consisting of upper portion 25A and 25B, FIG. 2, is closed with sucker rod coupling 20 and the lower end of the cylindrical vessel is closed with a lower ring 31 between the bottom of the lower tube 28 and the vessel. The ring member 31 has formed thereon a short tube 30 for extending the exit of the lower tube 28 and for mounting a latch thereon, described hereinafter. Upper tube 27 FIGS. 2 and 3A, is mounted in the cylindrical vessel 25 just below the slots 26 in an upper ring member 29. This upper ring member likewise has a connecting portion 31*a* for interconnecting with screw threads, FIG. 2, the upper cylindrical portion 25*a* with the cylindrical lower portion 25*b* for ease of assembly and disassembly of the sampler. An intermediate ring 32, FIG. 2, provides added support for lower tube 28 internally of cylinder lower portion 25*b* and has openings 33 to permit both vapor and liquid phases to pass downwardly therethrough.

Thus, an annulus is formed between the walls of the cylinder 25 FIG. 2, and the co-axial tubes 27 and 28 with upper and lower ring members 29 and 31 closing the ends of the annulus. Holes 34, FIGS. 2, 3A, 3B, and 3C, permit the steam vapor phase in the annulus to travel transversly into lower tube 28 FIGS. 2, 3C, to exhaust from the lower end thereof while the downwardly travelling steam liquid phase continues downwardly to fill the lower end of the annulus up to a predetermined volume as set by the lowest of the tube holes 34, the volume being 200 cc for the disclosed embodiment.

A mandrel or sealing tube 35, FIG. 2, is slideable in both co-axial tubes 27 and 28, it being illustrated in its open lowermost position wherein steam may pass straight through from upper tube 27, into lower tube 28, through sealing tube 35, and exhaust from the lower end of the sealing tube out into the well for penetration of the adjacent strata. Sealing tube 35 is raised to its uppermost position illustrated in enlarged details of FIGS. 3-B and 3-C to seal off the annulus from the tubes. In this position the upper end 35*a* with sealing O-rings 35*b*, FIG. 3-B, of the sealing tube has sealed the upper tube 27 therewith the sealing tube 35. Likewise, O-rings 38, FIG. 3-C, on the lower portion of the sealing tube 35 seals the lower end of the lower tube 28 for preventing steam from traversing the holes 34 in the tube 28. Accordingly, the two spaced apart co-axial tubes 27 and 28 are interconnected to form one continuous tube to effectively seal off the annulus from the tubes.

FIGS. 2 and 3-C disclose one embodiment of the sealing tube 35 with a J-latch 36 on short tube 30 for guiding the relative upward movement of the sealing tube as it telescopes into the two co-axial tubes 27, 28 until the sealing tube reaches its uppermost sealing position where it is locked in this latter position. Tube 30, a short tubular extension extending downwardly from the lower ring member 31 has an upside down J-type of groove so that the converging opening of the J-latch guides a cross-pin 37 on the lower end of sealing tube 35 into a locking slot where the cross pin is locked in the J-latch for maintaining the sealing tube protruding into both of the co-axial tubes 27, 28 FIG. 2, to accordingly seal them from the annulus therearound.

Briefly in operation, steam is injected at the top of the well into either the center tube 12, FIG. 1, or the annulus between well casing 11 and tube 12 by opening either valves 23 and 24, respectively. After the well is preheated, the sampler 15 is lowered to a position adjacent the well bottom or well bottom plate 16 in the petroliferous strata where the steam is injected and permitted to fill the internal annulus and purge the annulus for collecting a typical sample. Then after the sampler is lowered to the bottom for actuating the sealing tube or mandrel 35 upwardly to lock it in the J-latch 36, the sampler is raised to the surface, allowed to cool, and disassembled for recovery of the steam liquid phase for analysis. The sample may then be checked for either total dissolved solids or chloride content and compared with the steam generator feedwater total dissolved solids or chlorides to determine the quality of the steam or ratio of the total dissolved solids or chlorides in the liquid phase at the well bottom or point of injection to the total dissolved solids or chlorides in the feedwater at the surface. Conductivity meters provide an easy and simple system for analyzing for total dissolved solids.

The quality "Q" of the steam of a typical sample may be determined as follows: ( ppm-parts per million)

$$Q\,(\%) = 100\left[1 - \frac{\text{total dissolved solids entering wellhead}}{\text{total dissolved solids sample}}\right]$$

$$Q = 100\left[1 - \frac{1000\text{ ppm}}{5000\text{ ppm}}\right] = 80\%$$

Preferably the higher the quality of the steam at the point of injection into the earth, the greater the penetration and the greater the production of oil from the production wells.

MODIFICATION

Figure 4:
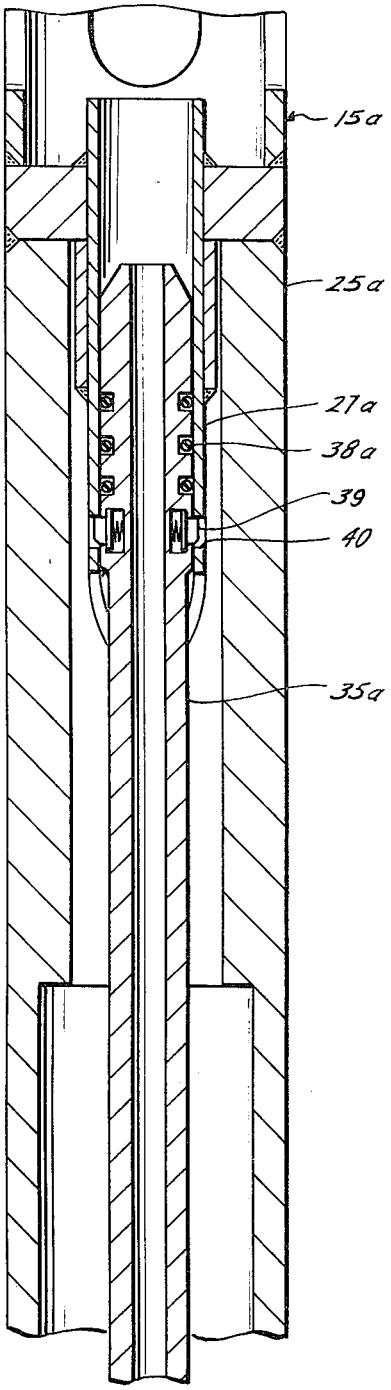
FIG. 4 is a modification of FIG. 2.

FIG. 4, a schematic sectional view of a modification of FIG. 2, discloses a steam sampler 15*a* with a different means for latching the sealing tube in sealed position.

The upper end portion of sealing tube 35*a*, FIG. 4, is similar to that of sealing tube 35 of FIG. 2. However, below the O-rings 38*a* FIG. 4, are mounted two protruding sealed spring loaded buttons 39 for sliding into a J-latch groove similar to the J-latch 36 of FIG. 3-C for forming a modified J-latch 40, FIG. 4.

In operation of the modified sampler 15*a* of FIG. 4, the cylindrical vessel 25 is hung adjacent the bottom of the well for 15 minutes, for example, and collect a full sample of steam liquid phase, the sampler is lowered to the well bottom or well bottom plate 16, FIG. 1. With further lowering of the sampler 15*a*, FIG. 4, the sealing tube 35*a* is telescoped upwardly into upper tube 27*a* with spring loaded buttons 39 guided in the J-latch groove to rotate to latched position. Then with the upward initial movement to recover the sample fluid, the buttons 39 become locked in the J-latch 40 until arriving at the surface. Then after cooling of the sampler, the sealing tube 35*a* is gripped at the bottom, raised, then twisted and withdrawn simultaneously from the J-latch 40 and the liquid recovered by unscrewing the two upper and lower portions 41*a*, 41*b*, respectively, from each other.

Obviously other methods may be utilized for collecting steam samples and for forming a steam sampler like the embodiments of either FIG. 2 of FIG. 4 than those listed above, depending on the particular information and liquid condensate desired.

Accordingly, it will be seen that at least one method for collecting a steam sampler at the bottom of a well, at least one method for forming a steam sampler, and at least two embodiments of a steam sampler have been described which will operate in a manner which meets each of the objects set forth hereinbefore.

While only two methods of the invention and two mechanisms have been disclosed, it will be evident that various other methods and modifications are possible in the arrangement and construction of the disclosed methods and steam collecting samplers without departing from the scope of the invention and it is accordingly desired to comprehend within the purview of this invention such methods and modifications as may be considered to fall within the scope of the appended claims.

We claim:

1. A method for collecting a sample of steam at a desired location down in a well comprising the steps of, a. passing the steam that has arrived at the desired location through a tube means internally of a cylindrical collecting vessel, b. passing a portion of the steam vapor phase and liquid phase from the tube means through an upper opening in the tube means out into an annulus formed between the tube means, and the cylindrical collecting vessel, c. passing the steam vapor phase back into the tube means through side openings therein and out an opening in the lower end of the tube means, d. collecting the steam liquid phase in the annulus, and e. sealing the annulus with a sample of steam liquid phase therein for recovery at the surface.

2. A method as recited in claim 1 wherein the first method step comprises, a. passing the steam that has arrived at the desired location through slots in the upper end of the cylindrical vessel, and b. passing the steam from the slotted upper end of the cylindrical vessel down into the upper end of the tube means therein.

3. A method as recited in claim 1 wherein the second method step comprises, a. passing a portion of the steam downwardly straight through the tube means to exit from the bottom of the cylindrical vessel, and b. passing the remainder of the steam vapor phase and liquid phase through the opening in the upper tube means out into the annulus.

4. A method as recited in claim 1 wherein the third method step comprises, a. passing the steam vapor phase portion that has entered the annulus back out of the annulus through the side openings in the tube means, and b. passing the steam vapor phase from the side openings in the tube means down and out of the tube lower end opening.

5. A method as recited in claim 1 wherein the fourth method step comprises, a. collecting the steam liquid phase in the annulus until the liquid level reaches the lowest opening in the tube means for collecting a predetermined amount of liquid phase, and b. flowing out of the annulus through the tube means side openings an amount of liquid phase equal to the new steam liquid phase collected thereafter to purge the annulus of the first formed steam liquid phase.

6. A method as recited in claim 1 wherein the fifth step comprises, a. inserting a hollow mandrel up into the lower end of the tube means with the lower end of the hollow mandrel protruding below the cylindrical vessel, b. raising the hollow mandrel relative to the tube means to close the openings in the tube means to accordingly seal any steam liquid phase in the annulus, c. raising the cylindrical vessel to the surface, and d. cooling the cylindrical vessel for removal of the steam liquid phase.

7. A method as recited in claim 6 wherein the second method step comprises, a. lowering the cylindrical vessel until the protruding hollow mandrel contacts a collar stop at the desired location in the well, b. lowering the cylindrical vessel slightly farther for telescoping the hollow mandrel farther into the tube means until the openings are sealed closed and the hollow mandrel locks in position.

8. A method for forming a sampler for collecting a sample of steam at a desired location indicated by a collar stop in a well comprising, a. forming an elongated cylinder having closed upper and lower ends with a diameter substantially less than that of the well to be sampled, b. attaching a coupling means on the cylinder upper end for connecting support means thereto for lowering the cylinder to a position adjacent the collar stop, c. forming slots in the cylinder upper end for receiving steam, d. fixedly mounting with an annular disk the top of an upper tube of two upper and lower co-axial, spaced apart tubes concentrically positioned in the upper portion of the cylinder below the slots for receiving the steam from the slots and for sealing the top of the upper portion of an annulus formed between the tubes and the cylinder, e. fixedly mounting with a second annular disk the lower end of the lower co-axial tube concentrically in the cylinder lower end for sealing the bottom of the lower portion of the annulus formed between the tubes and the cylinder, f. spacing the two co-axial tubes axially from each other a substantial distance so that a portion of the steam including the steam liquid phase and the steam vapor phase passes out into the annulus, g. perforating the upper end of the lower tube so that the steam vapor phase passes back into the lower tube through the perforations therein for exhausting from the cylinder bottom as the steam liquid phase collects in the annulus up to the perforations, and h. slideably mounting a sealing tube internally of the lower co-axial tube with a lower portion of the sealing tube protruding below the cylinder so that upon contact of the sealing tube lower portion with the well collar stop the sealing tube is slid upwardly to its uppermost position to close the perforations and the spacing between the two tubes for sealing the annulus with the steam liquid phase therein for recovery at the surface.

9. A method as recited in claim 8 wherein, a. said slideably mounted sealing tube has latch means for releasably locking the sealing tube in its uppermost position for sealing the condensate in the annulus for recovery at the surface.

10. A method as recited in claim 9 including the method step of, a. mounting a corresponding latch on the cylinder lower end for connecting with the latch means on the sealing tube for locking the sealing tube in its uppermost position for sealing the liquid phase in the annulus.

11. A method as recited in claim 9 including the method step of, a. mounting a corresponding latch on the upper co-axial tube for connecting with the latch means on the sealing tube for locking the sealing tube in its uppermost position for sealing the liquid phase in the annulus.

12. A sampler for collecting a sample of steam at a desired location indicated by a collar stop in well comprising, a. cylindrical vessel means having a slotted upper end for receiving steam and a lower end for ejecting the steam, b. coupling means on said upper end for attaching support means thereto for lowering the cylindrical vessel means to a position adjacent the desired location, c. tube means extending internally of said cylindrical vessel means from a point below said slotted upper end down and out the lower end for receiving steam from said slotted upper end and for ejecting the steam from the lower end, d. said cylindrical vessel means having closure means around each end of said tube means for forming a closed ended annulus around said tube means, e. openings in said tube means for permitting steam vapor phase and liquid phase therein to pass out into said annulus whereby the steam vapor phase passes back into said tube means for ejecting from said lower end and the steam liquid phase liquid phase collects in the annulus, and f. sealing tube means slideably mounted in said tube means responsive to contact with the collar stop for sealing said openings in said tube means for sealing said annulus with the steam liquid phase therein for recovery at the surface.

13. A sampler as recited in claim 12 wherein, a. said tube means comprises two upper and lower co-axial spaced apart tubes fixedly mounted in said cylindrical vessel means so that a substantial portion of said steam passes out into said annulus for separation of the steam liquid phase from the steam vapor phase.

14. A sampler as recited in claim 13 wherein, a. a plurality of holes are formed in an upper portion of said lower tube for permitting only the steam vapor phase to return to said lower tube thereby trapping the steam liquid portion in said annulus, and b. said lowest hole being positioned in the lower tube to permit all excess steam liquid phase over a predetermined amount to flow out of the holes to exit downwardly through the tube.

15. A sampler as recited in claim 12 wherein, a. said sealing tube means comprises a hollow mandrel slideably mounted in said tube means and extending from the lower end of said tube means and said cylindrical vessel means, b. said hollow mandrel being movable upwardly upon contact of its lower end with the well collar stop when the cylindrical vessel is lowered to the desired location in the well to seal all openings in said tube means to trap the steam liquid phase in said annulus, and c. said hollow mandrel having latch means thereon for releasably locking it relative to said tube means when said hollow mandrel has moved to its uppermost position for recovery of the steam condensate at the surface.

16. A sampler as recited in claim 15 wherein, a. said latch means has corresponding latch means mounted on said lower end of said cylindrical vessel means for releasably locking said hollow mandrel in fixed relationship to said tube means for sealing said tube means openings and accordingly sealing said annulus with the steam liquid phase therein for recovery at the surface.

17. A sampler as recited in claim 15 wherein, a. said latch means has corresponding latch means mounted on said tube means for releasably locking said hollow mandrel thereto in fixed relationship for sealing said tube means openings and accordingly sealing said annulus with the steam liquid phase therein for recovery at the surface.

18. A sampler for collecting a sample of steam at the bottom of a well comprising, a. a cylindrical vessel having open upper and lower ends, b. tube means extending longitudinally internally of said cylindrical vessel for receiving steam from said cylindrical vessel upper end and for ejecting it through a lower end of said tube means extending through said cylindrical vessel lower end, c. closure means for forming a closed ended annulus between said tube means and said cylindrical vessel, d. openings in said tube means for permitting the steam therein to pass out into said annulus for trapping the steam liquid phase in the annulus as the vapor phase passes back into said tube means for ejection, and e. sealing hollow mandrel means slideably mounted in said tube means responsive to contact with the well bottom for actuating said sealing hollow mandrel means to its uppermost position for sealing said tube means openings for sealing said annulus with the steam liquid phase therein.

19. A sampler as recited in claim 18 wherein, a. said sealing hollow mandrel means has latch means for releasably locking said sealing hollow mandrel means in its uppermost position for maintaining said annulus sealed with its steam liquid phase therein.

* * * * *

UNITED STATES PATENT AND TRADEMARK OFFICE

CERTIFICATE OF CORRECTION

PATENT NO. : 3,934,469

DATED : January 27, 1976

INVENTOR(S) : HOWARD et al

It is certified that error appears in the above-identified patent and that said Letters Patent are hereby corrected as shown below:

In the Abstract, line 12, after "position" the phrase --by contact with the well bottom of an intermediate collar-- should be inserted.

In the Claims:

Claim 1, paragraph a, lines 2 and 3, delete "through a tube means internally of a cylindrical", and insert --into a--.

Claim 1, paragraph b, lines 2 and 3, "from the tube means through an upper opening in the tube means out" should be deleted.

Claim 1, paragraph b, lines 4 and 5, "between the two means, and the cylindrical" should read --in the--.

Claim 1, paragraph c, lines 1 and 2, delete "back into the tube means through side openings therein and".

Claim 2, paragraph a, lines 2 and 3, "cylindrical" should read --collecting--.

Claim 3, paragraph a, line 3, "cylindrical" should read --collecting--.

Claim 3, paragraph b, line 2, "the" should read --an--.

Claim 6, paragraph a, line 2, "the" should be deleted and --a collecting vessel-- should be inserted.

Claim 6, paragraph b, lines 2 and 3, "close the openings in the tube means to accordingly" should be deleted.

UNITED STATES PATENT AND TRADEMARK OFFICE

CERTIFICATE OF CORRECTION

PATENT NO. : 3,934,469

DATED : January 27, 1976

INVENTOR(S) : HOWARD et al

It is certified that error appears in the above-identified patent and that said Letters Patent are hereby corrected as shown below:

Claim 6, paragraph c, line 1, "cylindrical" should read --collecting--.

Claim 6, paragraph d, line 1, "cylindrical" should read --collecting--.

Claim 7, paragraph a, line 1, "cylindrical" should read --collecting--.

Claim 7, paragraph a, line 1, "the protruding" should read --a--.

Claim 7, paragraph a, line 2, after "mandrel" should be inserted --protruding outwardly from a tube means in the collecting vessel--.

Claim 7, paragraph b, line 1, "cylindrical" should read --collecting--.

Claim 7, paragraph b, line 3, "the" should be deleted and after "openings" should be inserted --in the tube means--.

Claim 12, line 2, after "in", insert --a--.

Claim 18, paragraph a, "cylindrical" should read --collecting--.

Claim 18, paragraph b, line 1, the phrase "extending longitudinally internally of" should read --in--.

Claim 18, paragraph b, line 2, "cylindrical" should read --collecting--.

UNITED STATES PATENT AND TRADEMARK OFFICE

CERTIFICATE OF CORRECTION

PATENT NO. : 3,934,469

DATED : January 27, 1976

INVENTOR(S) : HOWARD et al

It is certified that error appears in the above–identified patent and that said Letters Patent are hereby corrected as shown below:

Claim 18, paragraph b, line 3, "cylindrical" should read --collecting--.

Claim 18, paragraph c, line 2, "cylindrical" should read --collecting--.

Signed and Sealed this

*Twenty-fourth* Day of *March 1981*

[SEAL]

*Attest:*

RENE D. TEGTMEYER

*Attesting Officer* *Acting Commissioner of Patents and Trademarks*